US007204392B2

(12) United States Patent
Kwasny et al.

(10) Patent No.: US 7,204,392 B2
(45) Date of Patent: Apr. 17, 2007

(54) PRESSURE PACK AEROSOL CAN FOR MIXING AND DISCHARGING TWO-CONSTITUENT MATERIALS

(75) Inventors: Peter Kwasny, Schaffhausen (CH); Christian Maras, Ohringen (DE)

(73) Assignee: Peter Kwasny GmbH (DE)

( * ) Notice: Subject to any disclaimer, the term of this patent is extended or adjusted under 35 U.S.C. 154(b) by 481 days.

(21) Appl. No.: 10/472,345

(22) PCT Filed: Mar. 15, 2002

(86) PCT No.: PCT/EP02/02885

§ 371 (c)(1),
(2), (4) Date: Feb. 17, 2004

(87) PCT Pub. No.: WO02/076852

PCT Pub. Date: Oct. 3, 2002

(65) Prior Publication Data

US 2004/0144808 A1 Jul. 29, 2004

(30) Foreign Application Priority Data

Mar. 23, 2001 (DE) ..... 101 14 624

(51) Int. Cl.

| | |
|---|---|
| ***B67D 5/00*** | (2006.01) |
| ***B67D 5/60*** | (2006.01) |
| ***B65D 83/00*** | (2006.01) |
| ***B65D 47/10*** | (2006.01) |

(52) U.S. Cl. ..... 222/83; 222/130; 222/394; 222/541.2

(58) Field of Classification Search ..... 222/130, 222/145.1, 80–83.5, 88, 90, 541.1, 541.2, 222/394

See application file for complete search history.

(56) References Cited

U.S. PATENT DOCUMENTS

| | | | | |
|---|---|---|---|---|
| 3,181,737 | A * | 5/1965 | Chaucer | 222/136 |
| 3,240,391 | A * | 3/1966 | Garton | 222/80 |
| 4,385,714 | A * | 5/1983 | Szabo et al. | 222/80 |
| 4,651,899 | A * | 3/1987 | Pauls et al. | 222/130 |
| 4,769,395 | A * | 9/1988 | Pauls | 521/99 |

* cited by examiner

*Primary Examiner*—Frederick C. Nicolas
*Assistant Examiner*—M A Cartagena
(74) *Attorney, Agent, or Firm*—Berliner & Associate

(57) ABSTRACT

The invention relates to a pressure pack aerosol can comprised of a body blank (2), of a dome (3) for accommodating a valve (4), of an inwardly arched bottom (5), of an inner sleeve (7), which is arranged on a disk (6), and of a tappet (9), which is arranged inside the inner sleeve (7), which is provided for splitting open said inner sleeve (7) and which can be displaced therethrough by the disk (6). According to the invention, the inner sleeve (7) is joined to the disk (6) via a spring cage (11), and the spring cage (11) contains a release mechanism (12), which is spring-mounted and which acts upon the tappet (9). Said tappet (9), in turn, acts upon a cover (8), which is arranged on the can-side end of the inner sleeve (7), and splits the cover open when actuated. A diaphragm (15) is arranged between the tappet (9) and the release mechanism (12) and hermetically seals the inner sleeve (7), on its disk-side end, off from the contents of the pressure pack aerosol can (1).

22 Claims, 5 Drawing Sheets

FIG. 3
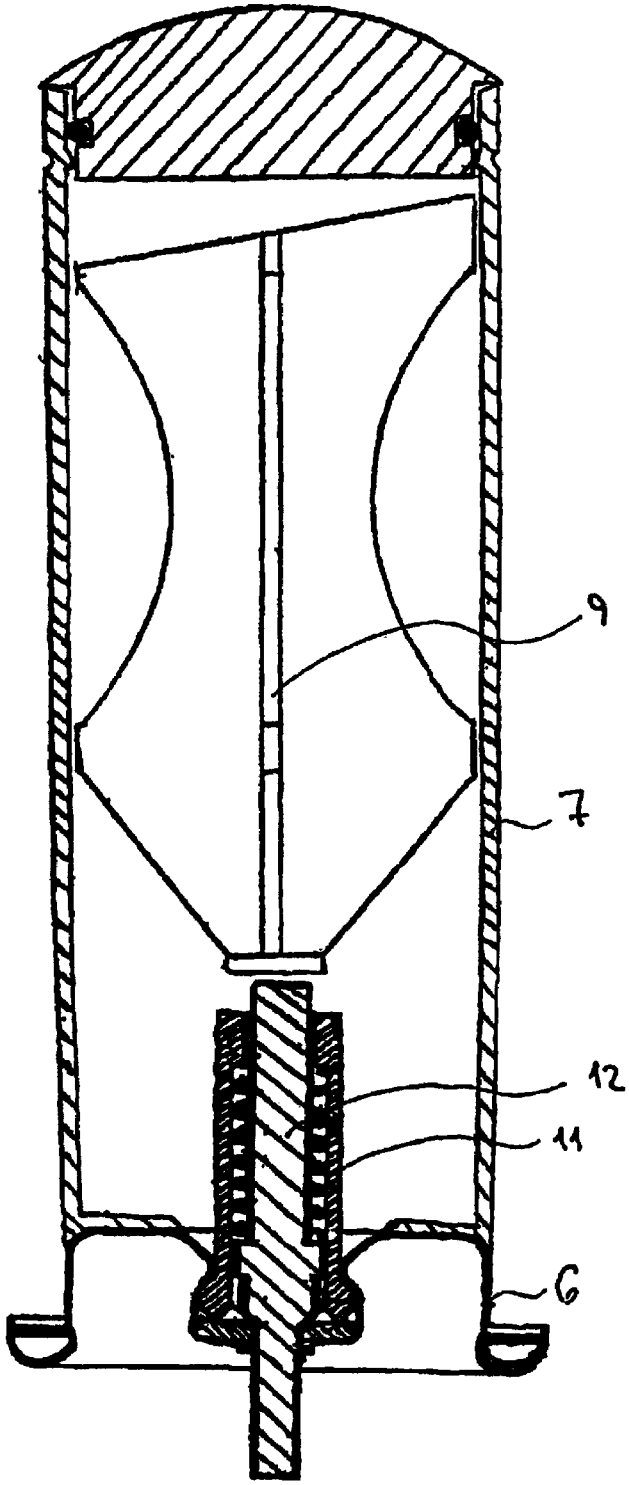
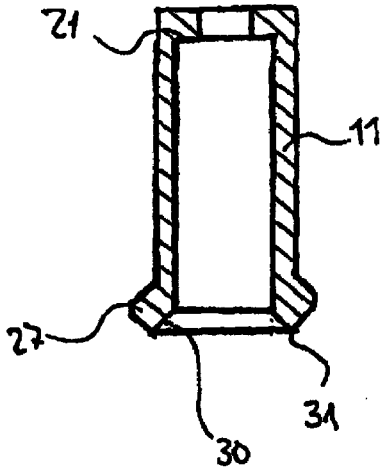
FIG. 4
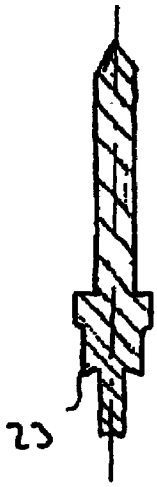
FIG. 5

PRESSURE PACK AEROSOL CAN FOR MIXING AND DISCHARGING TWO-CONSTITUENT MATERIALS

The invention relates to a pressure pack aerosol can comprised of a body blank, a dome for accommodating a valve, of an inwardly arched bottom, of an inner sleeve, which is arranged on a disk, of a tappet, which is arranged inside the inner sleeve, which is provided for splitting open said inner sleeve and which can be displaced through the disk, as well as to the use of pressure pack aerosol cans of this type for two-constituent materials. Pressure pack aerosol cans of this type are particularly suitable for storing and discharging two-constituent (2K) sealing and insulating foams, 2K-adhesives, and 2K-lacquers.

In particular, the invention also relates to the formation of pressure pack aerosol cans, which accommodate a second constituent in the inner sleeve, apart from the liquid substances of the master constituent, which reacts with the master constituent to become a finished product, for example a multiple-constituent lacquer. Likewise, however, the invention can also be applied to 2K-formulations for other purposes, for example in surface treatment technology or in generating plastic foams.

The substances of the master constituent contained in the pressure container are liquid and, for example, consist of a hardenable lacquer bonding agent, solvents, and the liquid propellant gas, which is utilized for discharging the constituent. The other constituent exists in a relatively small quantity inside an inner sleeve and mostly consists of a compound that quickly reacts with the master constituent, for example in the 2K-system polyisocyanate/polyole. Catalysts, if any, may also be present. The constituent in the inner sleeve serves for influencing product hardening and product quality, generally by accelerating the hardening, increasing the strength or resistance to weathering impacts, or the like. The second constituent is generally brought into the pressure pack aerosol can shortly before discharging the foam by splitting the cover of the internal container open and mixed therein by shaking.

Known from DE 82 27 229 U is a pressure pack aerosol can comprised of a one-partite bottom obtained by transformation of a molded part consisting of metal. The neck of an additional container is inserted into a recess of this bottom and provided with a male thread and restrained by the aid of a nut screwed on from outside by deformation of an O-ring seal between the shoulder of the additional container and the internal rim of the bottom recess. The rod sealed by a piston-like seal in the interior of the additional container is formed as a shaft that rotates in the additional container and rests inside on it. Driving the shaft from outside leads to a form-fit engagement of its inner end with the cover of the additional container, which is split-off against the internal pressure into the can.

WO 85/00157 A is the starting point for this invention is which describes a pressure pack aerosol can for discharging one-constituent or multiple-constituent substances which in its interior is provided with an additional container accommodating another constituent. The internal container is provided with an inner cover that can be split-off through a rod guided to the bottom of the pressure pack aerosol can onto the interior of the internal container. The tappet is flexibly supported inside the additional container and introduced through a sealing arranged in the bead disk of the can bottom. A pressure pack aerosol can pursuant to WO 85/00157 A is shown in FIG. 1.

Both prior art pressure pack aerosol cans are provided with an inner sleeve which is generally fabricated from polyolefines. The preferred material is polypropylene. These plastic materials have in fact proved to be reliable, but their disadvantage is that they are permeable to some propellant gas constituents and that they do not sufficiently withstand solvents, e.g. esters, ketones, and aromatics. However, particularly 2K-lacquers contain such solvents which have complicated their application from 2K-pressure pack aerosol cans up to now. Moreover, due to the multitude of constituent parts needed for their fabrication and due to their structure, cans of this type are relatively sophisticated and cost-intensive in fabrication. Owing to the material, particularly in combination of plastic and metal parts, problems in sealing occur again and again which are difficult to master and which cause mischarges again and again.

It is, therefore, the object of this invention to promote these known pressure pack aerosol cans to the effect that their inner sleeve forms an absolutely tight unit against the contents of the pressure pack aerosol can.

The pressure pack aerosol can of the first-mentioned type solves this task, wherein either the inner sleeve is connected via a spring cage with the disk, wherein said spring cage contains a spring-mounted release mechanism acting on the tappet, said tappet acting against a cover arranged at the can-side end of the inner sleeve and splitting it off when actuated, with a diaphragm being arranged between tappet and release mechanism, said diaphragm sealing the inner sleeve at its disk-side end hermetically against the contents of the pressure pack aerosol can, and wherein the inner sleeve is molded to a disk arranged in the bottom of the can, and wherein a spring cage is supported at the disk inside the inner sleeve, said spring cage being provided with a spring-mounted release mechanism acting on the tappet, said tappet acting against a cover arranged at the can-side end of the inner sleeve and splitting said cover off when actuated.

It was found out that the majority of problems faced with the inner sleeves of prior art cans results from the sealing of the tappet against the disk and the inner sleeve. Conversely, the sealing of the inner sleeve against the can contents in the area of the sleeve cover can be considered unproblematic; the sealing technique applicable there with sealing rings guided in grooves proved to be stable and practicable.

According to the present invention, the inner sleeve on its disk-side is provided with a diaphragm or, alternatively, molded to the bottom and/or bead disk so that a complete separation—without any use of sealing elements—against the other can contents is feasible in this critical area.

The inner sleeve employed in the pressure pack aerosol cans being the object of this invention may be fabricated from usual materials, but preferably it consists of aluminum. Variants of plastic material, for example polypropylene, are also feasible. In those areas where the inner sleeve is an integral part of the bottom disk, however, only a pressure-resistant material, preferably aluminum, can be used for pressure pack aerosol cans charged with an elevated pressure. The use of tinplate is also possible. Experts should know those techniques by which the corresponding plastic and metal parts are fabricated.

The inner sleeves of the pressure pack aerosol can according to this invention are preferably made of one part, both concerning the inner sleeve with the diaphragm and the inner sleeve with the molded-on bottom disk.

In the variant according to this invention with a diaphragm molded to the inner sleeve, the inner sleeve is connected via a spring cage to the bottom disk or valve disk. The bottom disk preferably is a disk like the one used at the valve-side end of the pressure pack aerosol can to integrate the valve unit into the can dome. Such disks can be manufactured extremely simply and at low cost. Hence, it results the advantage that a separate fabrication of a part is not required for the bottom disk. But of particular advantage is the arrangement of the inner sleeve at the valve disk in the dome of the can. The bottom disk can be dispensed with in this case.

The inner sleeve with the diaphragm is connected through a spring cage with the disk. For example, this may be accomplished in such a manner that the inner sleeve at its disk-side end is provided with a take-up that serves for a form-fit and/or non-positive fixing at the spring cage. The take-up and spring cage are expediently clinched or crimped with each other, with it being allowable for the spring cage to have a circumferential projection or groove to improve its seat, around which or into which the take-up is molded. Sealing elements are not required, because the diaphragm reliably prevents a penetration of the can contents into the inner sleeve. The diaphragm is expediently positioned at the transition from the inner sleeve to the take-up.

In a spring-mounted arrangement inside the spring sleeve there is a release mechanism which acts on the diaphragm, through it and onto the tappet in the inner sleeve. The disk-side end of the release mechanism—designated as tripping pin—projects through the disk out of the pressure pack aerosol can. The pin and the release mechanism may form one unit, but are separated if the inner sleeve is arranged at the valve disk; in that case, the release mechanism is provided with a take-up into which the pin engages to release the inner sleeve and into which a valve is placed after the can has been released and the pin removed. The spring path is so rated that the release mechanism drives the tappet reliably against the cover of the inner sleeve, splitting it out of its anchoring. In general, a spring path of approx. 5 to 10 mm is fully sufficient for this purpose; the tripping pin of the tappet projects by the same spring path from the disk bottom. To actuate the tappet, the can is pushed with the pin against a flat and firm surface or the pin is pressed-in manually.

It is advantageous to provide the spring sleeve at least with one breakthrough in order to facilitate pressure equalization between can space and inner space. If the inner sleeve is arranged at the valve disk, these breakthroughs also serve the purpose of allowing for a quick ventilation of the pressure pack aerosol can with propellant gas through the spring cage. Filling is performed at pressure rates of up to 60 bars; in order to avoid premature release of the inner sleeve due to a destruction of the diaphragm during the filling procedure, a quick pressure relief must be ensured. This pressure relief is effected through the breakthroughs, the overall cross-section of which expediently lies in a ratio of 3:1 to 6:1 versus the free cross-section of the filling appliance.

Thus, the diaphragm of the inner sleeve seals the contents of the inner sleeve during the can storage time reliably against the other can contents. Once the can has been released by actuating the tripping pin, the diaphragm is pierced. At the same time, the tappet drives the inner sleeve into the pressure pack aerosol can so that the sleeve contents becomes free and can mix itself with the can contents. For this purpose it is useful for the pressure pack aerosol can to contain a mixing aid, for example in form of a steel ball that can freely move in it.

In the alternative embodiment of the pressure pack aerosol can according to the present invention, the inner sleeve is integrally connected with the bottom disk, i.e. the inner sleeve and the disk are formed as a one-partite unit. In that case, the spring cage is located in the interior of the inner sleeve on the inside of the bottom disk. The release mechanism can be actuated by means of a pin through the disk of the bottom and, without the necessity for having to pierce a diaphragm, it acts immediately on the tappet, which splits-off the cover as described before. By formation of a unit comprised of the bottom disk and the inner sleeve, the disk-side hermetical sealing of the inner sleeve against the pressure pack aerosol can contents is ensured here.

In both embodiments, the spring cage is fixed in a central formation of the disk. This formation embraces the spring cage end extending outwardly at the bottom side and it prevents the spring cage from moving into the can along with the movement of the pin/release mechanism.

At the can side, the inner sleeve of the pressure pack aerosol can being the object of this invention is provided with a cover which is sealed in a usual manner by an O-ring resting in a groove. The groove is expediently located in part of the cover projecting into the valve-side end of the inner sleeve. At the same time, it is expedient for the inner sleeve to have an inner projection in the area of the cover sealing that co-acts directly with the inwardly projecting part of the cover and gives stability to the seat of the cover.

In an expedient embodiment, the tappet has several wings along a central axis, particularly four wings. It stabilizes the position of the tappet in the inner sleeve without requiring too much volume. To reduce the volume of the tappet still further, recesses or breakthroughs may be provided for. As the tappet and the release mechanism form separate units at least in the first variant, a separate guidance and stabilization of the tappet is indispensable. In the second variant, the tappet and release mechanism may form one unit.

To facilitate the process of splitting-off the cover, it is expedient to provide a contact point between tappet and cover in the periphery of the tappet, for example by arranging for the tappet to have its cover-nearest point at the periphery of one wing. In this manner, the cover is charged with a force in a decentralized way, thus promoting the split-off process.

In both embodiments, there is a sealing between spring cage and disk in the area of the central formation. The spring cage firmly crimped in the central formation acts against the sealing so that a discharge of the can contents through the disk is ruled out. The sealing, for example a rubber seal, has the shape of a pierced circular disk, through the center of which the pin of the release mechanism projects out of the pressure pack aerosol can. At its disk-side end, the release mechanism has a projection, expediently with a forward-projecting rim, which acts against the perforated disk-like sealing in the disk and causes an outward sealing in the area of the pin, too.

At its disk side, directly next to the sealing projection, the release mechanism has another projection, which serves as abutment for the helical spring guided in the spring cage. Serving as another abutment is an inner projection arranged at the valve-side end of the spring cage.

The spring ensures secure seating of the release mechanism with its sealing ring at the sealing rubber and at the same time, it allows for pressing-in the bolt by the desired length to trigger the inner sleeve.

Besides, the pressure pack aerosol can according to the present invention is manufactured and equipped conventionally. In particular, this applies to the valve area and to the valve-side equipment that allows for using the pressure pack aerosol can both in manual operation and as a cartridge on spray guns.

The invention is described in more details by way of the following figures, where:

FIG. 3 shows an inner sleeve for a pressure pack aerosol can in accordance with this invention pursuant to a second embodiment;

FIG. 4 shows a spring cage for a pressure pack aerosol can in accordance with this invention;

FIG. 5 shows a release mechanism for a pressure pack aerosol can in accordance with this invention;

FIGS. 1 to 7 are sectional figures.

Figure 1:
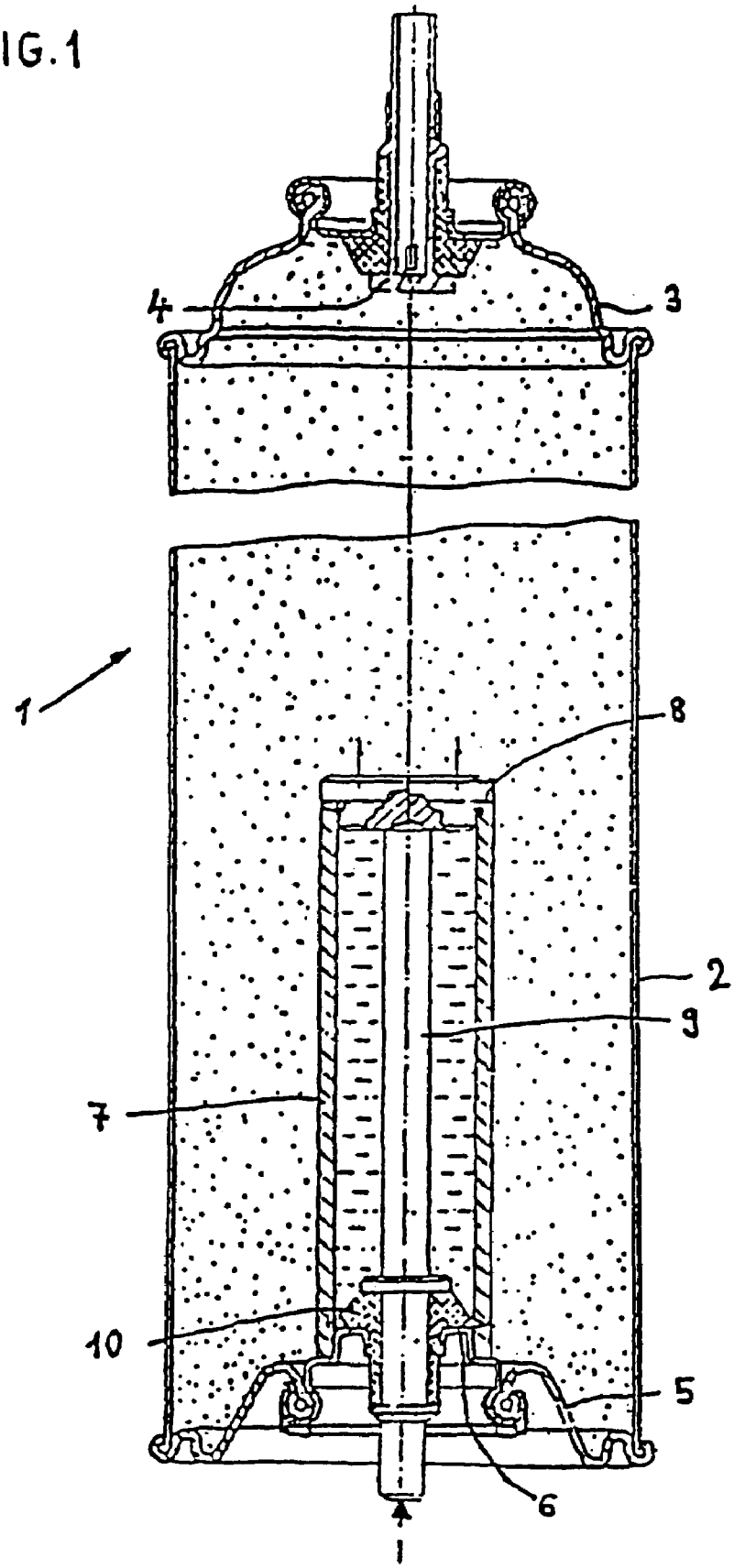
FIG. 1 shows a pressure pack aerosol can with inner sleeve pursuant to WO 85/00157 A.

The pressure pack aerosol can 1 as per FIG. 1 consists of a body blank 2 which at its upper end is locked with a dome 3. The dome 3 is provided with a bordered rim that connects dome and body blank with each other and which at the same time provides for a tight connection of these parts. The dome 3 is made of a round plate, a forming part cutout of sheet metal, which has received its arched shape by transformation, as shown on the relevant drawing. The inner rim of said dome 3 is also bordered and it accommodates a valve disk with a valve 4.

The bottom 5 is also connected via a bordered rim with body blank 2 and in its center, it is provided with a bottom disk 6, above which the inner sleeve 7 is located. The inner sleeve 7 has a cover 8 which can be split-off. In the interior of the inner sleeve 7, there is a tappet 9, the end of which is guided through a sealing element 10 at the bottom out of the cover. At both sides to the sealing element 10, the tappet 9 has limitation elements which both act against the sealing element 10 and which limit the free way length of the tappet 9 inside the inner sleeve 7. To split-off the cover 8 from the inner sleeve 7, the tappet 9 is pressed-in by hitting the can bottom onto a firm surface, causing the tappet to move upwardly. The rubber-elastic sealing element 10 absorbs this upward movement and, after cover 8 has been split-off, it leads the tappet 9 back into its home position.

Figure 2:
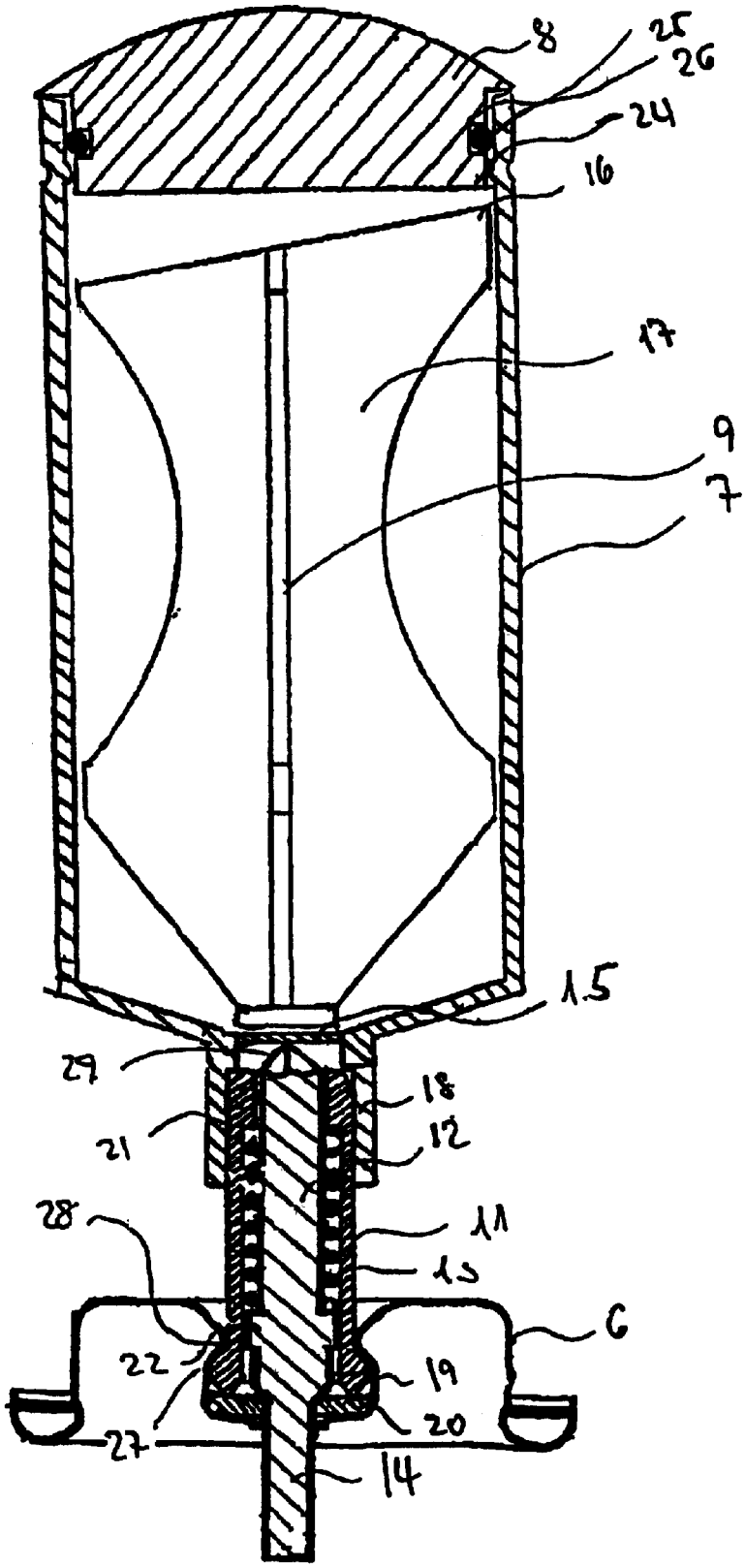
FIG. 2 shows an inner sleeve for a pressure pack aerosol can in accordance with this invention pursuant to a first embodiment for arrangement at a bottom disk.
Figure 6:
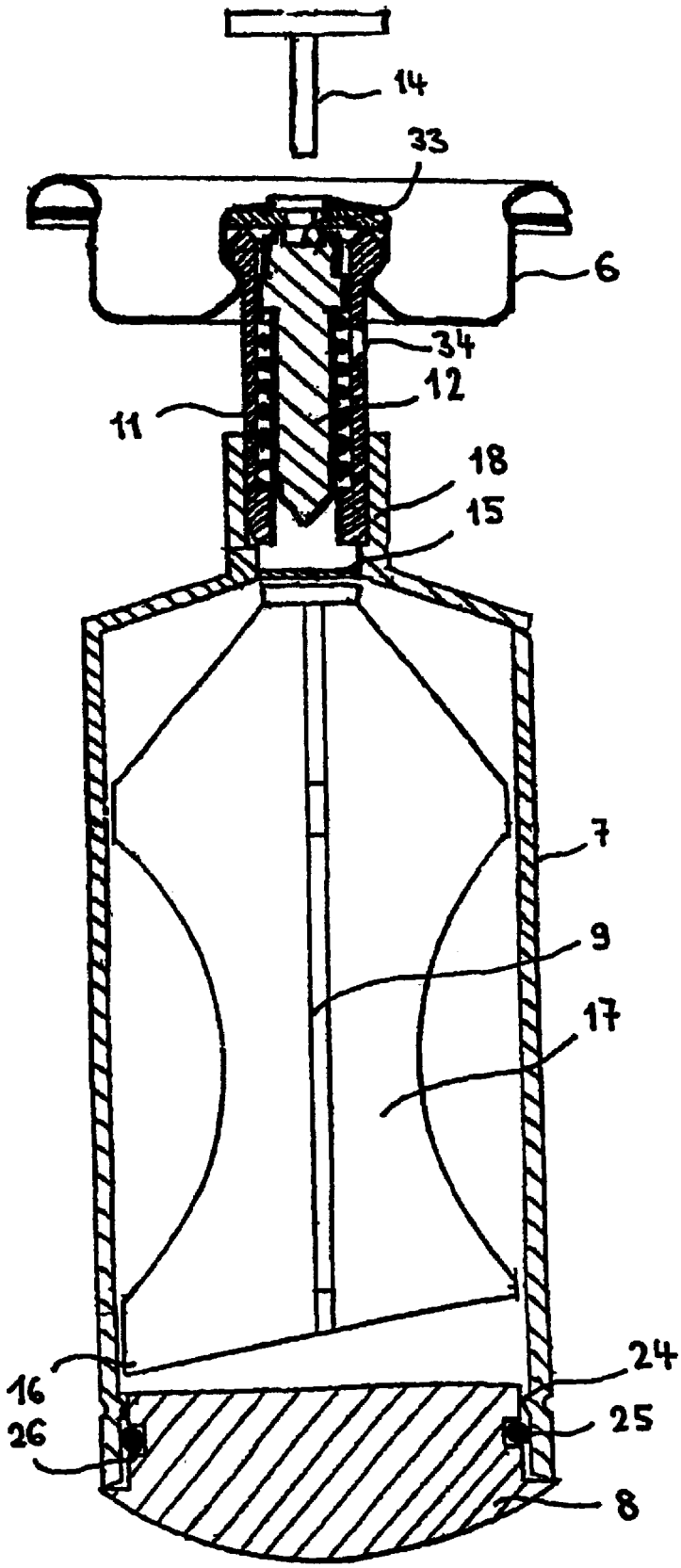
FIG. 6 shows an inner sleeve for a pressure pack aerosol can in accordance with this invention for arrangement at a valve disk.

Pursuant to this invention, the can according to FIG. 1 can be equipped with the inner sleeves as per FIG. 2, 3, or 6.

FIG. 2 shows an inner sleeve 7 with tappet 9 and cover 8 fabricated and applied according to this invention. The inner sleeve 7 has a cylindrical wall and at its disk side, a diaphragm seals it. At the disk side, there is a cylindrical take-up 18, which serves for fixing on spring cage 11.

The inner sleeve may be fabricated from a suitable plastic material, but expediently it is fabricated from aluminum. If fabricated from aluminum, suitable wall thickness rates for the wall are approx. 0.3 mm to 0.8 mm, and those for the diaphragm are approx. 0.05 to 0.10 mm.

At the can side, the inner sleeve 7 is locked with a cover 8 which may be made of aluminum or plastic. At its circumference, cover 8 has a groove 25 in which an O-ring is guided. To provide further support, the inner rim of the cover guided into the sleeve acts against a circumferential projection 24 which stabilizes the seat of the cover and which also facilitates splitting-off of the cover with the tappet 9.

The tappet 9 guided in the inner sleeve 7 has four wings 17 which are laterally cutout to reduce space demand. At the disk side, there is a disk-shaped closure which is located immediately at the can side of the diaphragm 15. At the can side, the tappet 9 is so chamfered that its cover-nearest point 16 lies in the periphery of one wing; when tappet 9 is actuated, the cover is detached from the projection 24 of the inner sleeve 7 and set free into the can. The inner sleeve 7 is plugged-on with its take-up 18 onto the can-side end of spring cage 11 and connected with it so firmly that a detachment on actuation of release mechanism 12 is ruled out.

The spring cage 11 itself consists of a plastic sleeve which at its can-side end is provided with an internally circumferential projection 21 that serves as abutment for a helical spring 13 resting therein. At the disk side, the helical spring 13 supports itself on a circumferential projection 22 of the release mechanism 12. In rest position, the spring 13 exerts a pressure on the release mechanism 12 so that it is pressed with its sealing seat 23 against the ring seal 20 arranged in disk 6. The release mechanism 12 terminates at its end projecting out of disk 6 in a bolt 14 which projects by that length out of the can which the release mechanism 12 needs to be pushed-in to split-off the cover 8 via tappet 9.

At the disk side, the spring sleeve 11 has an extension 27 which grabs behind the inner formation 19 of the bottom disk 6 to care for a non-displaceable seat at the bottom disk 6. On fabrication, the bottom disk 19 having the shape of a valve disk of a usual aerosol can is crimped around sealing 20 and around the spring cage 11 placed on top of it. The crimping procedure cares for a firm linkage between disk 6, spring cage 11, and sealing rubber 20, owing to the co-action of the molding 28 of the disk 6 and the extension 27 of spring cage 11.

The release mechanism 11 is subdivided into the section located inside the spring cage and an outwardly projecting pin 14 through which the tripping process is controlled. A tip 29 is located immediately adjacent to the diaphragm 15 and, if actuated, it acts against the bottom-side end of tappet 9. During this process, the diaphragm is destroyed, thus promoting the discharge of the contents of the inner sleeve into the can as well as the mixing of the two constituents. Immediately adjacent at the bottom side to abutment 22 is a circumferential sealing seat 23 which projects versus pin 14 and which acts with its projecting edge against the sealing 20.

FIG. 3 shows a second variant of an inner sleeve of the pressure pack aerosol can according to the present invention, in which the inner sleeve and the disk 6 are integrally connected with each other. In that case, too, at the disk side, the inner sleeve is completely sealed against the other can contents. Besides, the tappet and spring cage have the structure shown in FIG. 2 and the same effectiveness.

The lack of a diaphragm in the embodiment as per FIG. 3 allows for providing the release mechanism 12 and tappet 9 as one unit in another alternative embodiment. A tip at the release mechanism 12 for piercing of the diaphragm provided in FIG. 2 is not required any longer.

It should be noted that the inner sleeve as per FIG. 3 is preferably made of one piece, i.e. the inner sleeve 7 and the disk 6 are not connected to each other subsequently. The wall thickness rates of the sleeve and of the diaphragm here, too, are in a range from 0.3 mm to 0.8 mm. Likewise, however, it is also possible to glue or solder the inner sleeve and disk.

FIG. 4 shows a spring cage 11 according to this invention with a can-side abutment 21 for the helical spring resting therein and a disk-side extension 27 for crimping and a fixing at the bottom disk 6. The extension 27 in form of a circumferential bulb in this embodiment comes along with a cut-in 30 at the inner rim and the formation of a circumferential edge 31, which during the crimping process is pressed with the disk 6 against the rubber seal 20.

Finally, FIG. 5 shows a release mechanism 12 applied in accordance with the present invention, provided with a tip 29, abutment 22 for the helical spring, pin 14, and sealing seat 23 which, compared with the part of the release mechanism resting in the spring and compared with the pin 14, projects forward, but which, compared with the abutment 22, projects backward, said sealing seat 23 being provided with a circumferential edge acting against sealing 20; in the sectional view it is represented as a slight back-cutting.

FIG. 6 shows another preferred embodiment of an inner sleeve to be applied according to this invention, with the arrangement at a valve disk 6.

The arrangement of the inner sleeve at the valve disk bears the advantage that the aerosol can need not have any specifically configured bottom area. At the disk side, the inner sleeve 7 with tappet 9 and cover 8 has the diaphragm 15, which seals the inner sleeve hermetically towards the disk. At the disk side, a cylindrical take-up 18 is provided next which serves for fixing at the spring cage 11.

Apart from variants in the tripping area, the design of the inner sleeve as per FIG. 6 corresponds with that of FIG. 2.

The inner sleeve 7 with its take-up 18 is plugged-on onto the can-side end of the spring cage 11 and firmly connected to it so that a detachment on actuation of the release mechanism 12 is ruled out. The connection is expediently effected by clinching the take-up 18 with spring cage 11, preferably in such a manner that the free end of the take-up 18 is guided around an externally circumferential projection 32 (see FIG. 7) of the spring cage 11.

Since the spring cage 11 in the embodiment as per FIG. 6 together with the release mechanism 12 is also part of the valve mechanism, it is expedient to physically separate the release mechanism 12 from the tripping pin 14. For this purpose, the release mechanism 12 has a take-up 33 for the tripping pin 14 which takes-up the tripping pin for the tripping procedure, but from which the tripping pin can be pulled out again after the release. The same take-up subsequently accommodates a conventional valve head 4 like those used for aerosol cans. Preference is given to so-called female valves with lateral slots and a cog which projects into the take-up 33.

To facilitate the access of the can contents into the spring sleeve and thus to the valve, it is expedient to provide at least one breakthrough 34 in the spring cage. After release of the inner sleeve and exchange of the tripping pin 34 for a valve 4, the pressure pack aerosol can contents can stream through the breakthrough(s) 34 into the spring cage and discharged through the actuated valve 4 from the pressure pack aerosol can.

In the embodiment as per FIG. 6, the breakthroughs 34 fulfill another function in connection with the filling of the can. After can filling, the filled inner sleeve is put with the valve disk onto the can dome and crimped with it. Next, the can is filled with propellant gas through the valve opening, said propellant gas usually being propane, butane, dimethylether and/or fluorocarbon (134*a*). Filling of the can is performed at a pressure of up to 60 bars in order to keep this procedure as short as possible. At a pressure of up to 60 bars, however, there is the danger that the diaphragm 15 may burst under this pressure or because of the pressure-driven release mechanism 12. To counteract this danger, it is required to provide for a quickest-possible relief of the gases after their entrance into the can. Such a relief is achieved by arrangement of one or several major passage ports 34 into spring cage 11. Here it is expedient to provide these passage ports 34 with an overall cross-section that corresponds to the three-fold to six-fold of the clear cross-section of the filling needle through which the propellant gas streams into the pressure pack aerosol can.

The breakthroughs 34 in valve basket 11 are provided at the disk-side end of the valve basket, as near as possible to the valve itself. The valve-side sealing is accomplished by a sealing seat 23 provided at its disk-side end in the form of a circumferential projection acting against the sealing 20 between spring cage 11 and disk 6 in the area of the central formation 19. As compared with the embodiment as per FIG. 2, it is expedient to provide the release mechanism 12 at a larger distance to diaphragm 15 in order to absorb a certain excursion of the release mechanism 12 on filling of the pressure pack aerosol can with propellant gas without any danger for the diaphragm 15. It is self-understandable that the distance of the release mechanism 12 towards the diaphragm 15 must be reflected by the length of the tripping pin 14 in such a manner that the tripping pin has an overall length that corresponds to the distance of the release mechanism 12 towards the diaphragm and further by the way of the tappet 9 which it has to cover to split-off the cover 8. The length of the spring path is rated accordingly.

Figure 7:
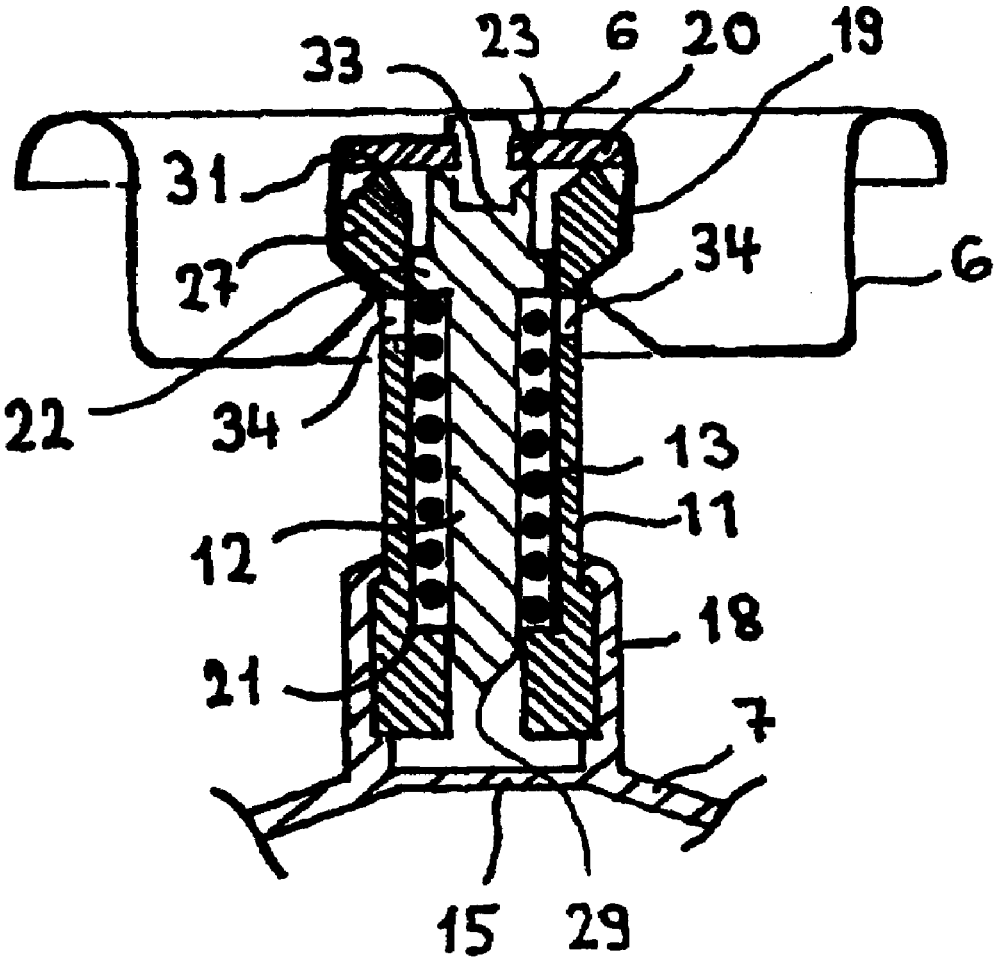
FIG. 7 shows the disk area of the embodiment in accordance with FIG. 6.

FIG. 7 shows a representation of the spring cage with the release mechanism 12 as per FIG. 6 in a detail. In its central area, the valve disk 6 has a formation 19 with a breakthrough into which a sealing 20 is inserted at the can side, said sealing having the shape of an open circular disk, preferably made of a rubber-like material. In the area of the formation 19, the spring cage 11 is fixed via its extension 27. The circumferential edge 31 arranged at the head side acts against the rubber seal 20 and seals the can contents against the central opening in the disk and in the seal 20. As a result of the crimping process on molding of the spring cage 11 into the central formation 19 of the valve disk 6, the individual constituents are in a form-fit and non-positive as well as tightly sealing connection to each other.

Immediately under the fixing at the valve disk 6, the spring cage 11 has breakthroughs 34 which allow the can contents to penetrate into the spring cage. Located inside the spring cage 11 is the helical spring 13, which rests on an inner projection 21 of the spring cage 11 and against an outer projection 22 of the release mechanism 12. In relaxed status, the helical spring 13 presses the release mechanism 12 with its circumferential edge 23 against the sealing rubber 20 so that the pressure pack aerosol can is sealed in this status.

To release the inner sleeve, the tripping pin 14 is inserted into the recess 33 of the release mechanism 12 and powerfully pressed down so that the release mechanism 12 with its tip 29 pierces through the diaphragm 15, moving the tappet 9 located underneath against the cover 8. Upon release, the release mechanism 12 returns to its home position so that the can remains sealed towards the outside. During the tripping process, sealing is accomplished by co-action of the flanks of the tripping pin with the rubber seal 20.

For discharging the can contents, a conventional valve is inserted into the recess 33, which is actuated by being pressed-in. In that case, the release mechanism moves by a defined way into the can so that the can contents may escape unrestrictedly through the breakthroughs 34 into the spring cage and out of the valve.

Furthermore, the breakthroughs 34 serve the purpose of allowing for filling the already sealed can with propellant gas through the central opening in the sealing 20, enabling the propellant gas to get quickly into the can contents. For this purpose, with the propellant gas feed through sealing 20, the propellant gas is pressed with the intended pressure into the spring sleeve so that the release mechanism 12 moves by a defined way towards the diaphragm 15, but without reaching it, so that the gas can escape laterally into the can under relief, once the breakthroughs 34 have become free.

Pressure cans according to the embodiment as per FIG. 6 are applied "head over heels, i.e. the valve points to the bottom. If a riser pipe is brought in, pressure pack aerosol cans pursuant to FIGS. 2 and 3 can be utilized in upright position or, if there is no riser pipe, "head over heels". A use with spray guns is possible and envisaged. To be noted in this connection is that the term "can-side" as applied in this application designates an arrangement directed can-inwardly, while the term "disk-side" designates an arrangement towards the relevant disk (in the valve or bottom area).

The invention claimed is:

1. A pressure pack aerosol can with a body blank (2), a dome (3) to accommodate a valve (4), an inwardly arched bottom (5), inner sleeve (7) arranged at a disk (6), a tappet (9) arranged at the inner sleeve (7) to split-off the inner sleeve (7), said tappet being able to be actuated through the disk (6), characterized in that the inner sleeve (7) is connected via a spring cage (11) with the disk (6), said spring cage (11) having a spring-mounted release mechanism (12) acting on the tappet (9), said tappet (9) acting against a cover (8) arranged at the can-side end of the inner sleeve (7) and splitting it off when actuated, with a diaphragm (15) being arranged between the tappet (9) and the release mechanism (12), said diaphragm sealing the inner sleeve (7) at its bottom disk-side end hermetically against the contents of the pressure pack aerosol can (1).

2. A pressure pack aerosol can pursuant to claim 1, characterized in that the diaphragm (15) and inner sleeve (7) are fabricated as a one-partite unit.

3. A pressure pack aerosol can pursuant to claim 2, characterized in that the inner sleeve (7) has a take-up (18) at its outer end for fixing at the spring cage (11).

4. A pressure pack aerosol can pursuant to claim 3, characterized in that the diaphragm (15) is arranged at the transition from the inner sleeve (7) to the take-up (18).

5. A pressure pack aerosol can pursuant to claim 3 or claim 4, characterized in that the take-up (18) is clinched with a spring cage (11).

6. A pressure pack aerosol can pursuant to claim 5, characterized in that the free end of the take-up (18) is guided around an externally circumferential projection (32) of the spring cage (11).

7. A pressure pack aerosol can pursuant to claim 1, characterized in that the inner sleeve is arranged at a disk (6) in the bottom (5) of the pressure pack aerosol can (1).

8. A pressure pack aerosol can pursuant to claim 1, characterized in that the disk (6) with the inner sleeve (7) are arranged in the dome (2) of the pressure pack aerosol can (1).

9. A pressure pack aerosol can pursuant to claim 8, characterized in that the release mechanism (12) has a take-up (33) for a tripping pin (14) or a valve (4).

10. A pressure pack aerosol can with a body blank (2), a dome (3) to accommodate a valve (4), a bottom (5), an inner sleeve (7) arranged at a disk (6), a tappet (9) arranged in the inner sleeve (7) to split-up the inner sleeve (7), said tappet being able to be actuated through the disk (6), characterized in that the inner sleeve (7) is molded to the disk (6) arranged in the bottom (5) of the can (1), and that a spring cage (11) rests at the disk (6) inside the inner sleeve (7), said spring cage (11) containing a spring-mounted release mechanism (12) acting on the tappet (9), said tappet (9) acting against a cover (8) arranged at the can-side end of the inner sleeve (7) and splitting it off when actuated, and said inner sleeve (7) and said disk (6) being of a one-partite configuration.

11. A pressure pack aerosol can pursuant to claim 1 or 10, characterized in that the spring cage (11) is fixed in a central formation (19) of the disk (6).

12. A pressure pack aerosol can pursuant to claim 1 or 10, characterized in that the inner sleeve (7) and the cover (8) are sealed through an O-ring (26) resting in a groove (25).

13. A pressure pack aerosol can pursuant to claim 1 or 10, characterized in that the tappet (9) has several wings (17) along a central axis.

14. A pressure pack aerosol can pursuant to claim 13, characterized in that the tappet (9) has its cover-nearest point (16) at the periphery of a wing (17).

15. A pressure pack aerosol can pursuant to claim 13, characterized in that the wings (17) have cutouts and/or recesses.

16. A pressure pack aerosol can pursuant to claim 1 or 10, characterized by a sealing (20) between spring cage (11) and disk (6) in the area of the central formation (19).

17. A pressure pack aerosol can pursuant to claim 1 or 10, characterized in that the spring cage (11) has an internal projection (21) as an abutment for a spring element (13) at its valve-side end.

18. A pressure pack aerosol can pursuant to claim 12, characterized in that the release mechanism (12) at its disk-side end has a peripheral projection (22) serving as abutment for the spring element (13).

19. A pressure pack aerosol can pursuant to claims 1 or 10, characterized in that the release mechanism (12) at its disk-side end has a sealing seat (23) in form of a circumferential projection.

20. A pressure pack aerosol can pursuant to claim 1 or 10, characterized in that the inner sleeve (7) in the area of the cover (8) has an inner projection (24) which co-acts with the cover (8).

21. A pressure pack aerosol can pursuant to claim 1 or 10, characterized in that the inner sleeve (7) is made of aluminum.

22. A pressure pack aerosol can pursuant to claim 1 or 10, characterized in that the spring cage (11) has at least one breakthrough (34).

* * * * *